US009799465B2

(12) United States Patent
Jhuang et al.

(10) Patent No.: US 9,799,465 B2
(45) Date of Patent: Oct. 24, 2017

(54) KEY STRUCTURE

(71) Applicant: Primax Electronics Ltd., Neihu, Taipei (TW)

(72) Inventors: Chuang-Shu Jhuang, Taipei (TW); Song-Hui Han, Taipei (TW)

(73) Assignee: PRIMAX ELECTRONICS LTD., Neihu, Taipei (TW)

( * ) Notice: Subject to any disclaimer, the term of this patent is extended or adjusted under 35 U.S.C. 154(b) by 0 days.

(21) Appl. No.: 15/131,824

(22) Filed: Apr. 18, 2016

(65) Prior Publication Data

US 2017/0162345 A1 Jun. 8, 2017

(30) Foreign Application Priority Data

Dec. 2, 2015 (CN) ..... 2015 1 0872894

(51) Int. Cl.

| | |
|---|---|
| ***H01H 13/70*** | (2006.01) |
| ***H01H 13/14*** | (2006.01) |
| ***H01H 3/12*** | (2006.01) |
| ***H01H 13/705*** | (2006.01) |

(52) U.S. Cl.

CPC ..... *H01H 13/14* (2013.01); *H01H 3/125* (2013.01); *H01H 13/705* (2013.01); *H01H 2221/036* (2013.01)

(58) Field of Classification Search

CPC ..... H01H 13/14; H01H 2221/036; H01H 13/705; H01H 2221/002; H01H 2221/058; H01H 2231/002; H01H 3/00; H01H 3/02; H01H 3/12; H01H 13/00; H01H 13/26; H01H 13/20; H01H 13/50; H01H 13/70; H01H 2003/00; H01H 2003/12

USPC ..... 200/314, 5 R, 5 A, 46, 510–514, 520, 200/521, 308, 310, 311, 312, 313, 318.1, 200/337, 341, 343, 344, 345; 20/314, 20/5 R, 5 A, 46, 510–514, 520, 521, 308, 20/310, 311, 312, 313, 318.1, 337, 341, 20/343, 344, 345

See application file for complete search history.

(56) References Cited

U.S. PATENT DOCUMENTS 6,091,036 A * 7/2000 Hu ..... H01H 3/125 200/344

* cited by examiner

*Primary Examiner* — Anthony R. Jimenez

(74) *Attorney, Agent, or Firm* — Kirton McConkie; Evan R. Witt

(57) ABSTRACT

A key structure includes a base, a triggering element, a keycap and a scissors-type connecting element. The keycap is disposed over the triggering element. When an external force is applied to the keycap, the triggering element is pushed by the keycap. The scissors-type connecting element is connected with the keycap and the base. The scissors-type connecting element includes a first frame and a second frame. The first frame includes a keycap post, a base post and a bulge. The bulge is externally extended from a first end of the first frame and located at a side of the keycap post, and the bulge is protruded from a sidewall of the first frame. Due to the bulge, the structured strength of the keycap post is enhanced.

16 Claims, 11 Drawing Sheets

KEY STRUCTURE

FIELD OF THE INVENTION

The present invention relates to a key structure, and more particularly to a key structure with a scissors-type connecting element.

BACKGROUND OF THE INVENTION

Generally, the widely-used peripheral input device of a computer system includes for example a mouse, a keyboard, a trackball, or the like. Via the keyboard, characters or symbols can be directly inputted into the computer system. As a consequence, most users and most manufacturers of input devices pay attention to the development of keyboards. As known, a keyboard with scissors-type connecting elements is one of the widely-used keyboards.

Hereinafter, a key structure with a scissors-type connecting element of a conventional keyboard will be illustrated with reference to FIG. 1. FIG. 1 is a schematic side cross-sectional view illustrating a conventional key structure. As shown in FIG. 1, the conventional key structure 1 comprises a keycap 11, a scissors-type connecting element 12, a rubbery elastomer 13, a membrane switch circuit member 14 and a base 15. The keycap 11, the scissors-type connecting element 12, the rubbery elastomer 13 and the membrane switch circuit member 14 are supported by the base 15. The scissors-type connecting element 12 is used for connecting the base 15 and the keycap 11.

The membrane switch circuit member 14 comprises plural key intersections (not shown). When one of the plural key intersections is triggered, a corresponding key signal is generated. The rubbery elastomer 13 is disposed on the membrane switch circuit member 14. Each rubbery elastomer 13 is aligned with a corresponding key intersection. When the rubbery elastomer 13 is depressed, the rubbery elastomer 13 is subjected to deformation to push the corresponding key intersection of the membrane switch circuit member 14. Consequently, the corresponding key signal is generated.

The scissors-type connecting element 12 is arranged between the base 15 and the keycap 11, and the base 15 and the keycap 11 are connected with each other through the scissors-type connecting element 12. The scissors-type connecting element 12 comprises a first frame 121 and a second frame 122. A first end of the first frame 121 is connected with the keycap 11. A second end of the first frame 121 is connected with the base 15. The rubbery elastomer 13 is enclosed by the scissors-type connecting element 12. Moreover, the first frame 121 comprises a first keycap post 1211 and a first base post 1212. The first frame 121 is connected with the keycap 11 through the first keycap post 1211. The first frame 121 is connected with the base 15 through the first base post 1212. The second frame 122 is combined with the first frame 121. A first end of the second frame 122 is connected with the base 15. A second end of the second frame 122 is connected with the keycap 11. Moreover, the second frame 122 comprises a second keycap post 1221 and a second base post 1222. The second frame 122 is connected with the keycap 11 through the second keycap post 1221. The second frame 122 is connected with the base 15 through the second base post 1222.

The operations of the conventional key structure 1 in response to the depressing action of the user will be illustrated as follows. Please refer to FIG. 1 again. When the keycap 11 is depressed, the keycap 11 is moved downwardly to push the scissors-type connecting element 12 in response to the depressing force. As the keycap 11 is moved downwardly relative to the base 15, the keycap 11 pushes the corresponding rubbery elastomer 13. At the same time, the rubbery elastomer 13 is subjected to deformation to push the membrane switch circuit member 14 and trigger the corresponding key intersection of the membrane switch circuit member 14. Consequently, the membrane switch circuit member 14 generates a corresponding key signal. When the keycap 11 is no longer depressed by the user, no external force is applied to the keycap 11 and the rubbery elastomer 13 is no longer pushed by the keycap 11. In response to the elasticity of the rubbery elastomer 13, the rubbery elastomer 13 is restored to its original shape to provide an upward elastic restoring force. Consequently, the keycap 11 is returned to its original position where it is not depressed.

The above key structure is used in a keyboard module of a notebook computer. In comparison with the keyboard of a desktop computer, the keyboard module of the notebook computer is thinner and the keycap of the keyboard module is slimmer. Consequently, the keyboard module of the notebook computer is favored by many users. Since the conventional key structure 1 is thinner, some components of the conventional key structure 1 are readily damaged during the assembling process. For example, during the process of assembling the scissors-type connecting element 12 with the base 15 and the keycap 11, the first keycap post 1211 that is connected with the keycap 11 is broken easily.

Therefore, there is a need of providing a slim and low-damage key structure.

SUMMARY OF THE INVENTION

The present invention provides a slim and low-damage key structure.

In accordance with an aspect of the present invention, there is provided a key structure. The key structure includes a base, a triggering element, a keycap, and a scissors-type connecting element. The triggering element is triggered in response to an external force. The keycap is disposed over the triggering element. When the external force is applied to the keycap, the triggering element is pushed by the keycap. The scissors-type connecting element is connected with the keycap and the base, and includes a first frame and a second frame. The first frame has a first end connected with the keycap and a second end connected with the base. The first frame includes a first keycap post, a first base post and a bulge. The first keycap post is located at the first end of the first frame, protruded from a sidewall of the first frame, and connected with the keycap. The first base post is located at the second end of the first frame, and connected with the base. The bulge is externally extended from the first end of the first frame and formed on a first side of the first keycap post. In addition, the bulge is protruded from the sidewall of the first frame. The second frame is combined with the first frame. A first end of the second frame is connected with the base. A second end of the second frame is connected with the keycap.

In accordance with another aspect of the present invention, there is provided a key structure. The key structure includes a base, a triggering element, a keycap, and a scissors-type connecting element. The triggering element is triggered in response to an external force. The keycap is disposed over the triggering element. When the external force is applied to the keycap, the triggering element is pushed by the keycap. The scissors-type connecting element is connected with the keycap and the base, and includes a first frame and a second frame. A first end of the first frame is connected with the keycap. A second end of the first frame is connected with the base. The second frame is combined with the first frame. A first end of the second frame is connected with the base. A second end of the second frame is connected with the keycap. The second frame includes a first base post, a first keycap post and a bulge. The first base post is located at the first end of the second frame, protruded from a sidewall of the second frame, and connected with the base. The first keycap post is located at the second end of the second frame, and connected with the keycap. The bulge is externally extended from the first end of the second frame and formed on a first side of the first base post. In addition, the bulge is protruded from the sidewall of the second frame.

From the above descriptions, the present invention provides the key structure. In the scissors-type connecting element of the key structure, a bulge is formed on a sidewall of the keycap post or a sidewall of the base post in order to increase the volume of the keycap or the base post. Consequently, the structural strength is increased, and the damage probability is reduced. Moreover, due to the arrangement of the bulge, the keycap or the base has a mating structure corresponding to the bulge. Consequently, the scissors-type connecting element can be smoothly combined with the keycap or the base, and the action of the scissors-type connecting element is not influenced by the bulge.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

For solving the drawbacks of the conventional technologies, the present invention provides a key structure with enhanced structural strength and slim appearance.

Figure 1:
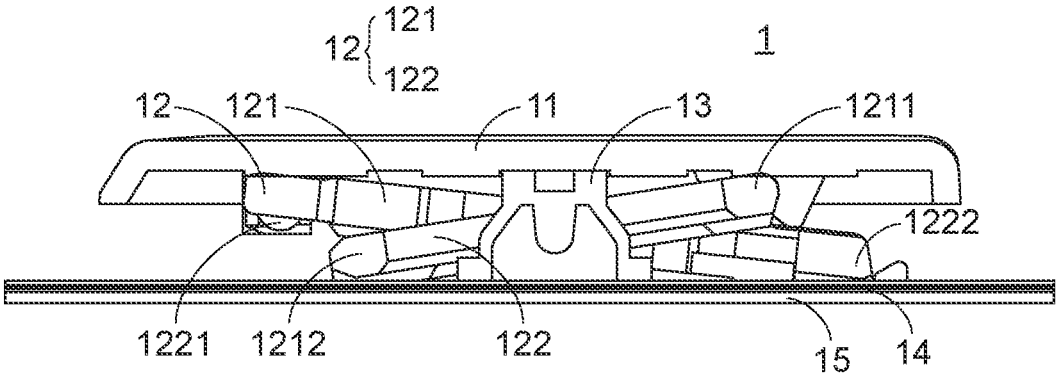
FIG.1 PRIOR ART
FIG. 1 is a schematic side cross-sectional view illustrating a conventional key structure.
Figure 2:
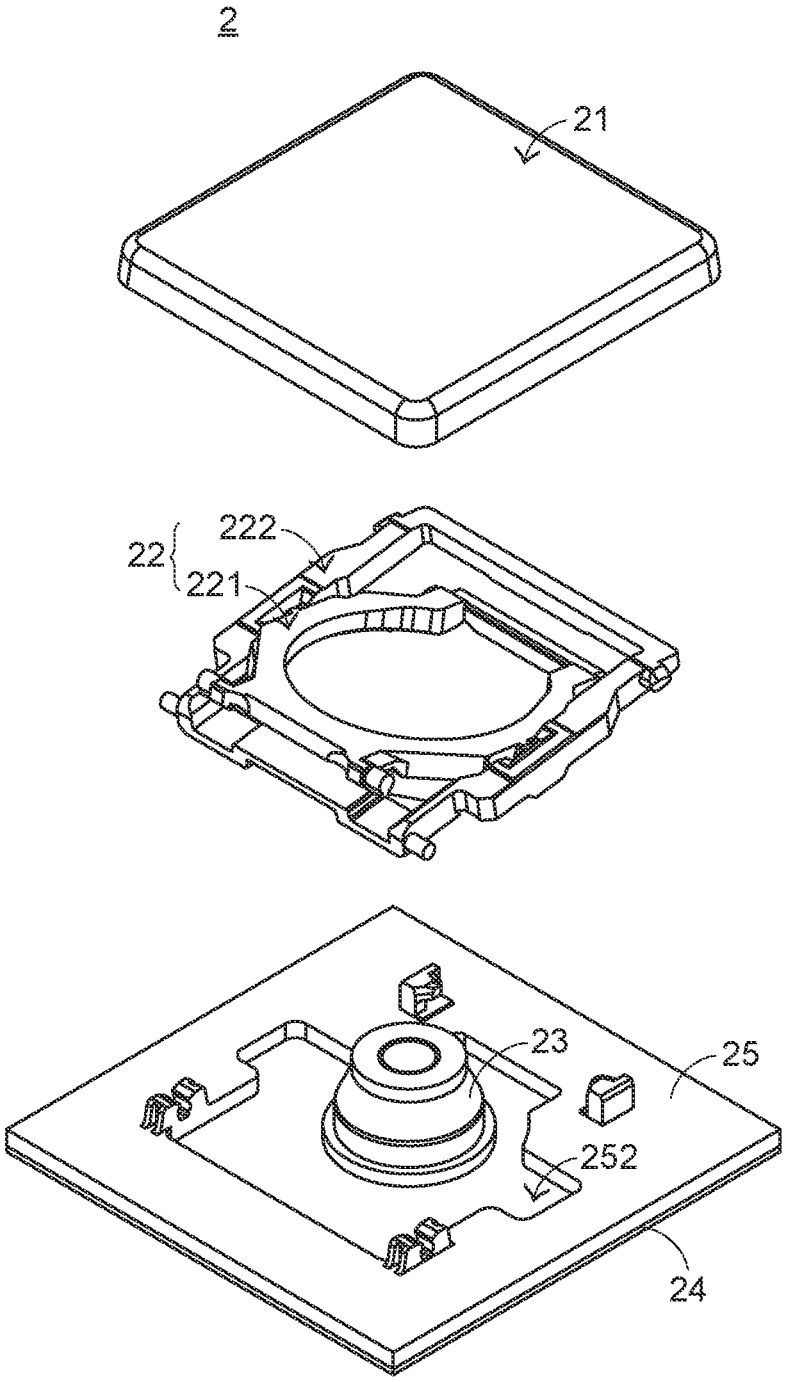
FIG. 2 is a schematic exploded view illustrating a key structure according to a first embodiment of the present invention.
Figure 3:
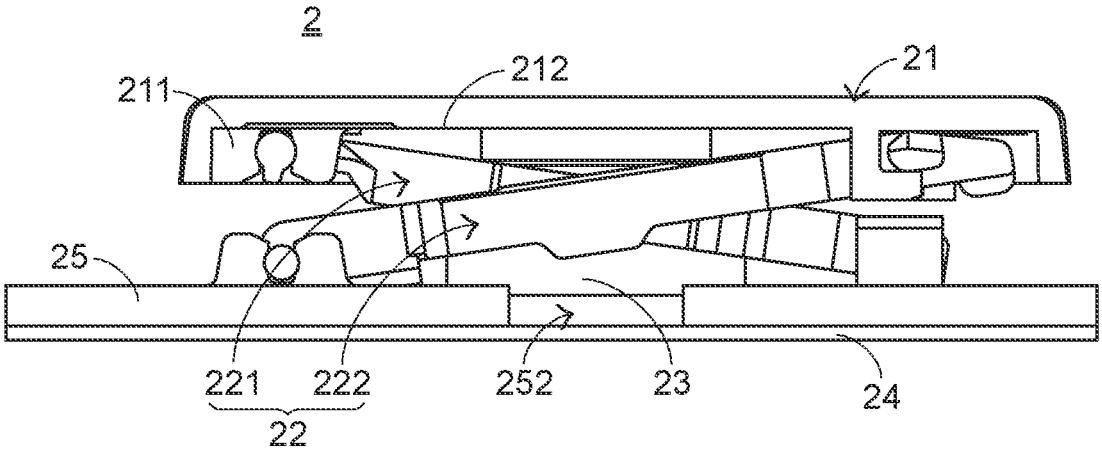
FIG. 3 is a schematic side cross-sectional view illustrating the key structure according to the first embodiment of the present invention.

FIG. 2 is a schematic exploded view illustrating a key structure according to a first embodiment of the present invention. FIG. 3 is a schematic side cross-sectional view illustrating the key structure according to the first embodiment of the present invention. As shown in FIGS. 2 and 3, the key structure 2 comprises a keycap 21, a scissors-type connecting element 22, a triggering element 23, a switch circuit board 24 and a base 25. The keycap 21, the scissors-type connecting element 22 and the triggering element 23 are supported by the base 25. The base 25 and the keycap 21 are connected with each other through the scissors-type connecting element 22. As shown in FIG. 3, the components of the key structure 2 from top to bottom include the keycap 21, the scissors-type connecting element 22, the base 25 and the switch circuit board 24 sequentially. The triggering element 23 is arranged between the keycap 21 and the switch circuit board 24. Moreover, the triggering element 23 is enclosed by the scissors-type connecting element 22.

The base 25 has an opening 252 in the center. The triggering element 23 is penetrated through the opening 252 of the base 25. The switch circuit board 24 is disposed under the base 25. Moreover, the switch circuit board 24 is disposed under the triggering element 23 and contacted with the triggering element 23. The switch circuit board 24 has a key intersection (not shown) corresponding to the triggering element 23. In case that the triggering element 23 is subjected to deformation, the key intersection is triggered to generate a key signal. The keycap 21 is disposed over the triggering element 23. In response to an external force applied to the keycap 21, the keycap 21 is moved relative to the base 25 to push the triggering element 23. The scissors-type connecting element 22 is used for connecting the key 21 with the base 25. Through the scissors-type connecting element 22, the keycap 21 is movable upwardly or downwardly relative to the base 25. In this embodiment, the triggering element 23 is a rubbery elastomer, and the switch circuit board 24 is a membrane switch circuit member under the base 25. It is noted that numerous modifications and alterations may be made while retaining the teachings of the invention. For example, in another embodiment, the switch circuit board is a membrane switch circuit member over the base, and the opening for penetrating the triggering element is not included in the base.

Figure 4:
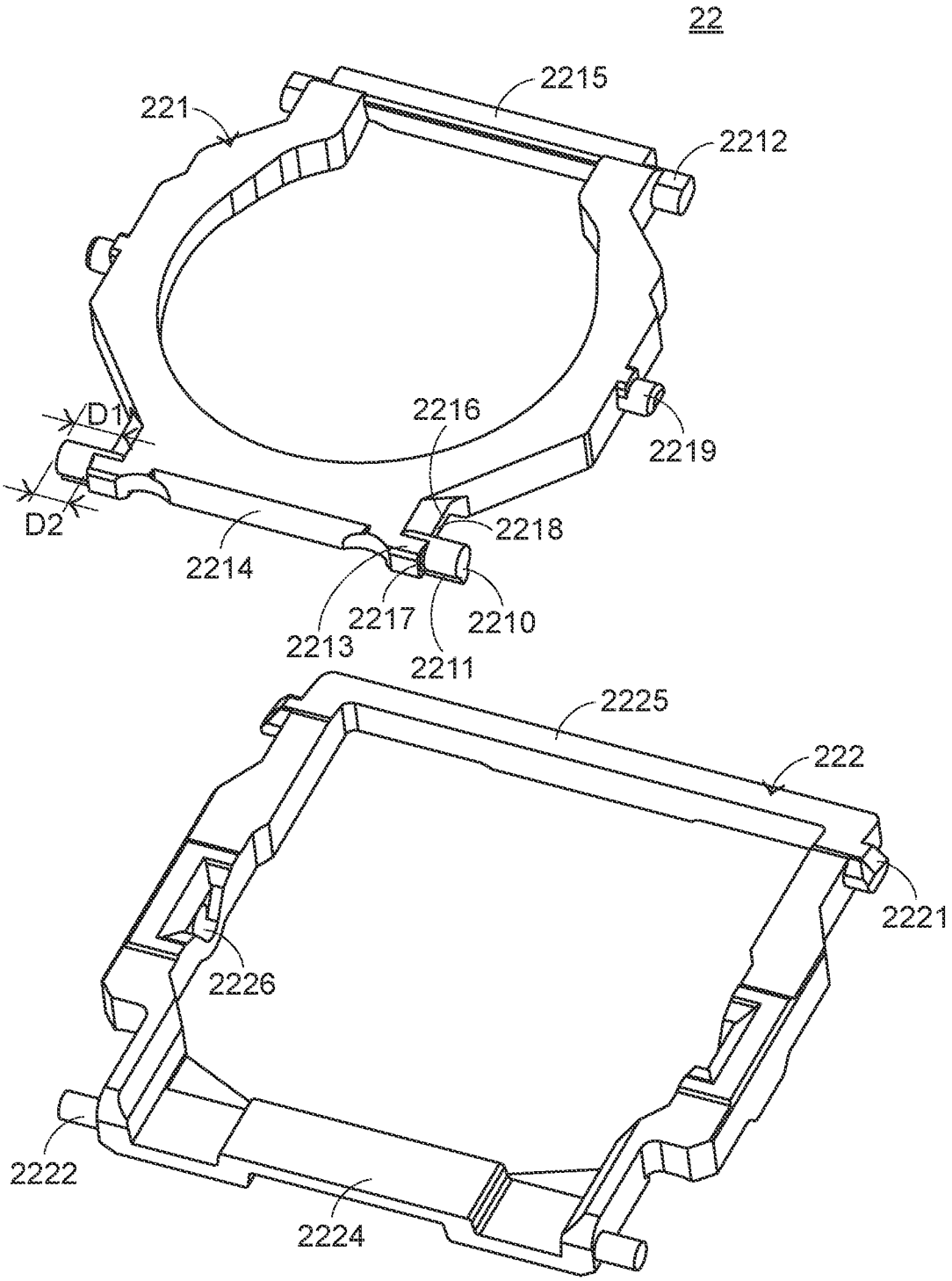
FIG. 4 is a schematic exploded view illustrating the scissors-type connecting element of the key structure according to the first embodiment of the present invention.

Hereinafter, the structure of the scissors-type connecting element 22 will be illustrated with reference to FIG. 4. FIG. 4 is a schematic exploded view illustrating the scissors-type connecting element of the key structure according to the first embodiment of the present invention. As shown in FIG. 4, the scissors-type connecting element 22 comprises a first frame 221 and a second frame 222. A first end 2214 of the first frame 221 is connected with the keycap 21. A second end 2215 of the first frame 221 is connected with the base 25. Moreover, the first frame 221 comprises a first keycap post 2211, a first base post 2212 and a bulge 2213. The first keycap post 2211 is located at the first end 2214 of the first frame 221, and protruded from a sidewall 2216 of the first frame 221. The first keycap post 2211 is connected with the keycap 21. The first base post 2212 is located at the second end 2215 of the first frame 221, and connected with the base 25. The bulge 2213 is externally extended from the first end 2214 of the first frame 221 along a longitudinal direction of the first keycap post 2211, and formed on a first side of the first keycap post 2211. Moreover, the bulge 2213 is protruded from the sidewall 2216 of the first frame 221. Consequently, a lateral surface 2217 of the bulge 2213 and a first lateral surface 2218 of the sidewall 2216 of the first frame 221 are not coplanar.

The second frame 222 is combined with the first frame 221. A first end 2224 of the second frame 222 is connected with the base 25. A second end 2225 of the second frame 222 is connected with the keycap 21. The second frame 222 comprises a second keycap post 2221 and a second base post 2222. The second keycap post 2221 is located at the second end 2225 of the second frame 222, and connected with the keycap 21. The second base post 2222 is located at the first end 2224 of the second frame 222, and connected with the base 25. As shown in FIG. 4, the first frame 221 further comprises a rotating shaft 2219, and the second frame 222 further comprises a coupling recess 2226 corresponding to the rotating shaft 2219. The rotating shaft 2219 is located at the sidewall of the first frame 221. In addition, the rotating shaft 2219 is in parallel with the first keycap post 2211 and the first base post 2212. The rotating shaft 2219 is inserted into the corresponding coupling recess 2226, so that the first frame 221 and the second frame 222 are combined together. When the rotating shaft 2219 is rotated within the coupling recess 2226, the first frame 221 is swung relative to the second frame 222 and the scissors-type connecting element 22 is activated.

In this embodiment, the first keycap post 2211, the first base post 2212 and the bulge 2213 are integrally formed with the first frame 221, and the second keycap post 2221 and the second base post 2222 are integrally formed with the second frame 222.

After associated components are combined with each other, the key structure 2 as shown in FIG. 2 is assembled. The operations of the conventional key structure 2 in response to the depressing action of the user will be illustrated as follows. When the keycap 21 is depressed, the keycap 21 is moved downwardly to push the scissors-type connecting element 22 in response to the depressing force. Consequently, the scissors-type connecting element 22 is activated. As the keycap 21 is moved downwardly relative to the base 25, the keycap 21 pushes the corresponding triggering element 23. At the same time, the triggering element 23 is subjected to deformation to push the membrane switch circuit member 24 and trigger the corresponding key intersection of the membrane switch circuit member 24. Consequently, the membrane switch circuit member 24 generates a corresponding key signal. When the keycap 21 is no longer depressed by the user, no external force is applied to the keycap 21 and the triggering element 23 is no longer pushed by the keycap 21. In response to the elasticity of the triggering element 23, the triggering element 23 is restored to its original shape to provide an upward elastic restoring force. In response to the upward elastic restoring force, the keycap 21 is returned to its original position where it is not depressed.

The following two aspects should be specially described. Firstly, as shown in FIG. 4, the bulge 2213 is protruded from the sidewall 2216 of the first frame 221. Consequently, a first distance D1 between a lateral surface 2210 of the first keycap post 2211 and the first lateral surface 2218 of the sidewall 2216 of the first frame 221 is larger than a second distance D2 between the lateral surface 2210 of the first keycap post 2211 and the lateral surface 2217 of the bulge 2213. In addition, the lateral surface 2217 of the bulge 2213 and the first lateral surface 2218 of the sidewall 2216 are in parallel with each other. Since the bulge 2213 at the first side of the first keycap post 2211 increases a portion of the thickness of the first keycap post 2211, the structural strength of the first keycap post 2211 is increased.

Figure 5:
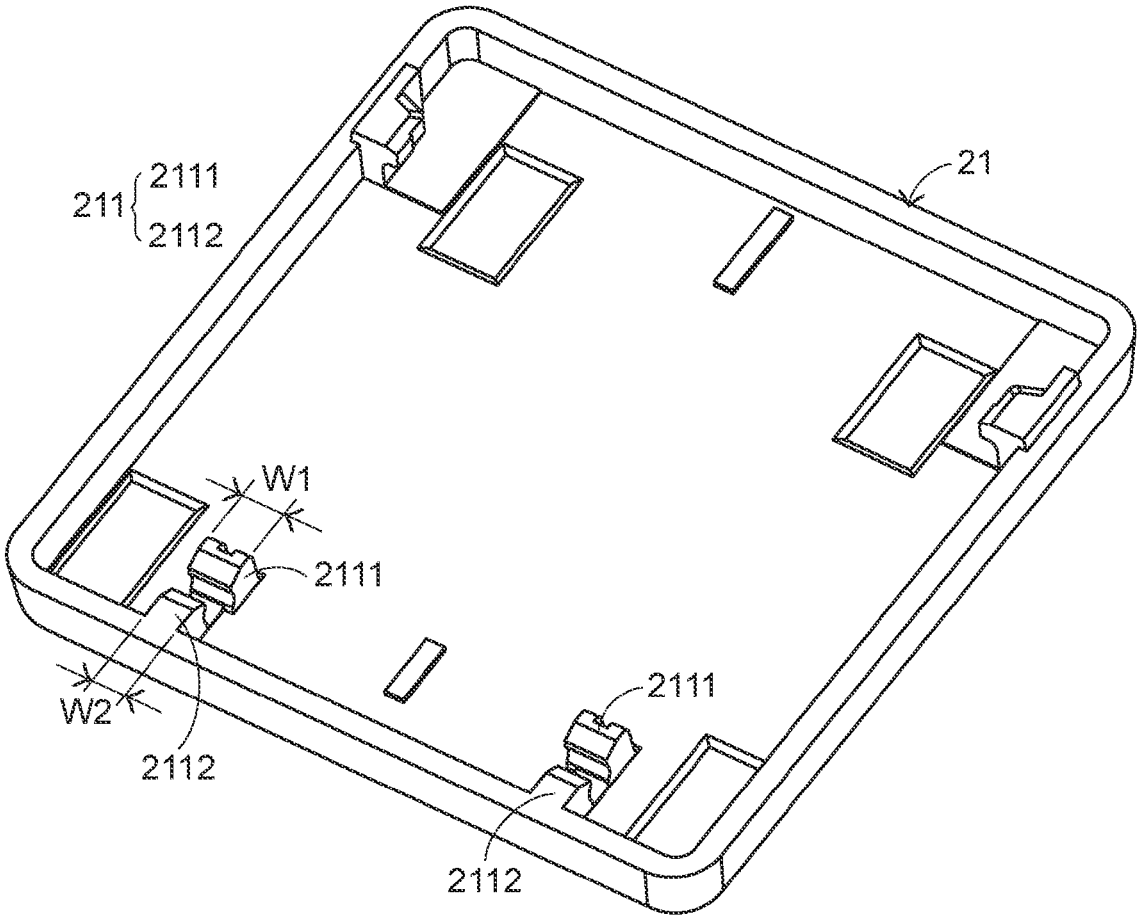
FIG. 5 is a schematic view illustrating a bottom side of the keycap of the key structure according to the first embodiment of the present invention.

Secondly, the keycap 21 further comprises a mating structure corresponding to the bulge 2213. FIG. 5 is a schematic view illustrating a bottom side of the keycap of the key structure according to the first embodiment of the present invention. As shown in FIG. 5, the keycap 21 comprises a hook structure 211. The hook structure 211 is disposed on a bottom surface of the keycap 21, and connected with the first keycap post 2211. The hook structure 211 comprises a first fixing part 2111 and a second fixing part 2112. The first fixing part 2111 is protruded from the bottom surface of the keycap 21, and contacted with a second side of the first keycap post 2211. The second side of the first keycap post 2211 is opposed to the first side of the first keycap post 2211, where the bulge 2213 is located at the first side of the first keycap post 2211. The second fixing part 2112 is protruded from the bottom surface of the keycap 21, and located beside the first fixing part 2111. The second fixing part 2112 is contacted with the first side of the first keycap post 2211. That is, the second fixing part 2112 is located near the bulge 2213, but is not contacted with the bulge 2213. Due to the arrangement of the bulge 2213, a first width W1 of the first fixing part 2111 is larger than a second width W2 of the second fixing part 2112. Since the first fixing part 2111 and the second fixing part 2112 of the hook structure 211 have different widths, the scissors-type connecting element 22 can be smoothly combined with the keycap 21. Moreover, the first frame 221 can be swung relative to the second frame 222 more smoothly, and the swinging action is not adversely affected by the bulge 2213.

Figure 6:
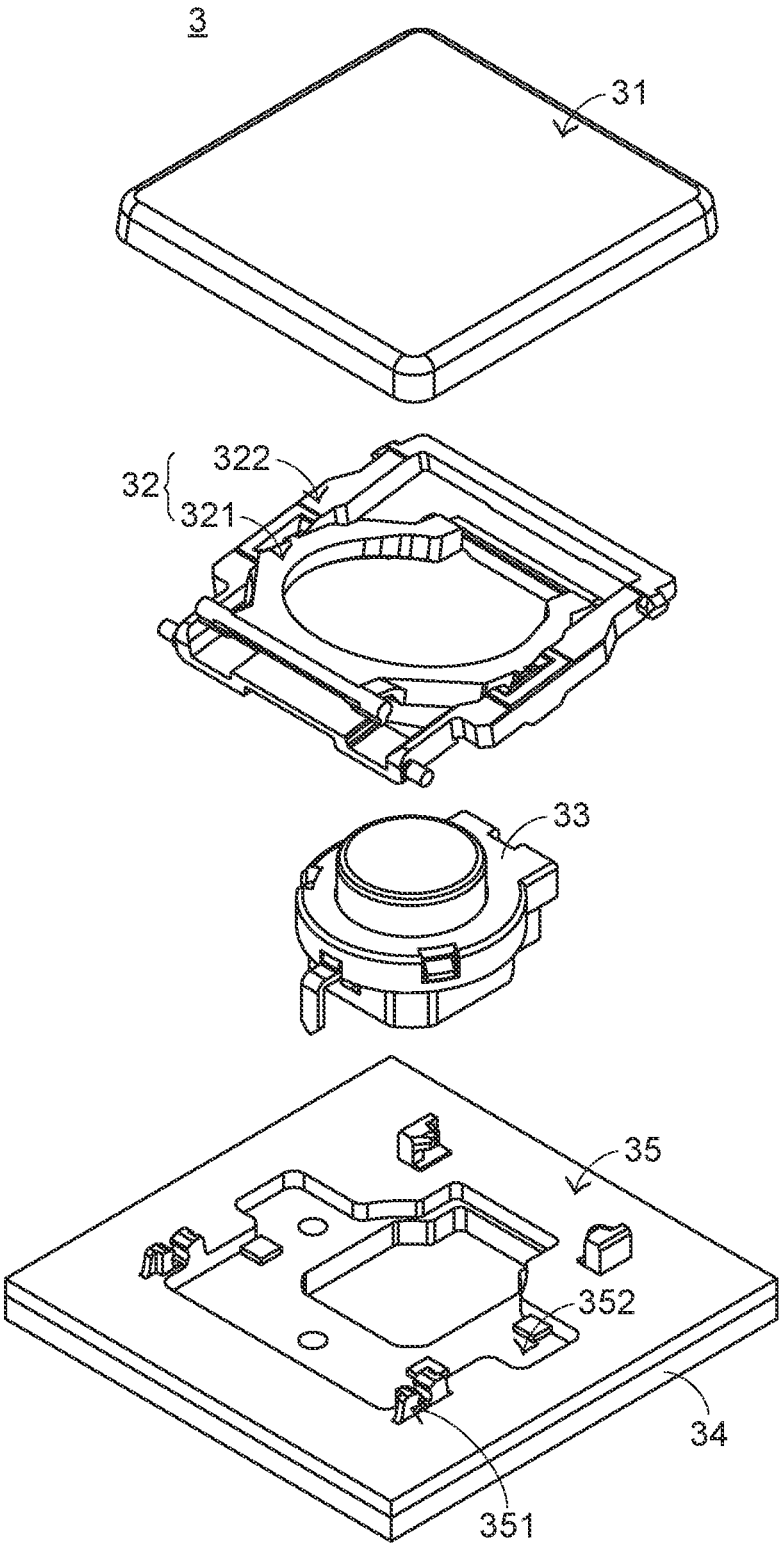
FIG. 6 is a schematic exploded view illustrating a key structure according to a second embodiment of the present invention.
Figure 7:
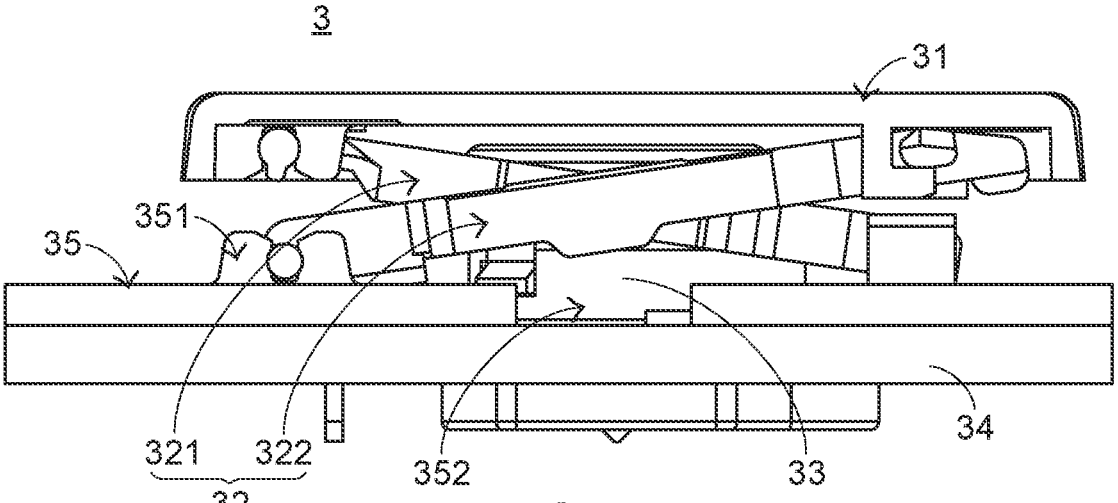
FIG. 7 is a schematic side cross-sectional view illustrating the key structure according to the first embodiment of the present invention.

The present invention further provides a second embodiment, which is distinguished from the first embodiment. FIG. 6 is a schematic exploded view illustrating a key structure according to a second embodiment of the present invention. FIG. 7 is a schematic side cross-sectional view illustrating the key structure according to the first embodiment of the present invention. As shown in FIGS. 6 and 7, the key structure 3 comprises a keycap 31, a scissors-type connecting element 32, a triggering element 33, a circuit board 34 and a base 35. The base 35 and the keycap 31 are connected with each other through the scissors-type connecting element 32. The circuit board 34 is disposed under the base 35. The triggering element 33 is supported by the circuit board 34, and electrically connected with the circuit board 34. The triggering element 33 is penetrated through the base 35 and the scissors-type connecting element 32, and contacted with the keycap 31. As shown in FIG. 7, the components of the key structure 3 from top to bottom include the keycap 31, the scissors-type connecting element 32, the base 35 and the circuit board 34 sequentially. The triggering element 33 is arranged between the keycap 31 and the switch circuit board 34.

The keycap 31 is disposed over the triggering element 33. In response to an external force applied to the keycap 31, the keycap 31 is moved relative to the base 35 to push the triggering element 33. The scissors-type connecting element 32 is used for connecting the key 31 with the base 35. Through the scissors-type connecting element 32, the keycap 31 is movable upwardly or downwardly relative to the base 35. The triggering element 33 is penetrated through the scissors-type connecting element 32 and opening 352 of the base 35, and electrically connected with the underlying circuit board 34. When the triggering element 33 is pushed by the keycap 31, the triggering element 33 generates a key signal to the circuit board 34. In this embodiment, the triggering element 33 is a triggering switch, and the circuit board 34 is a printed circuit board.

Figure 8:
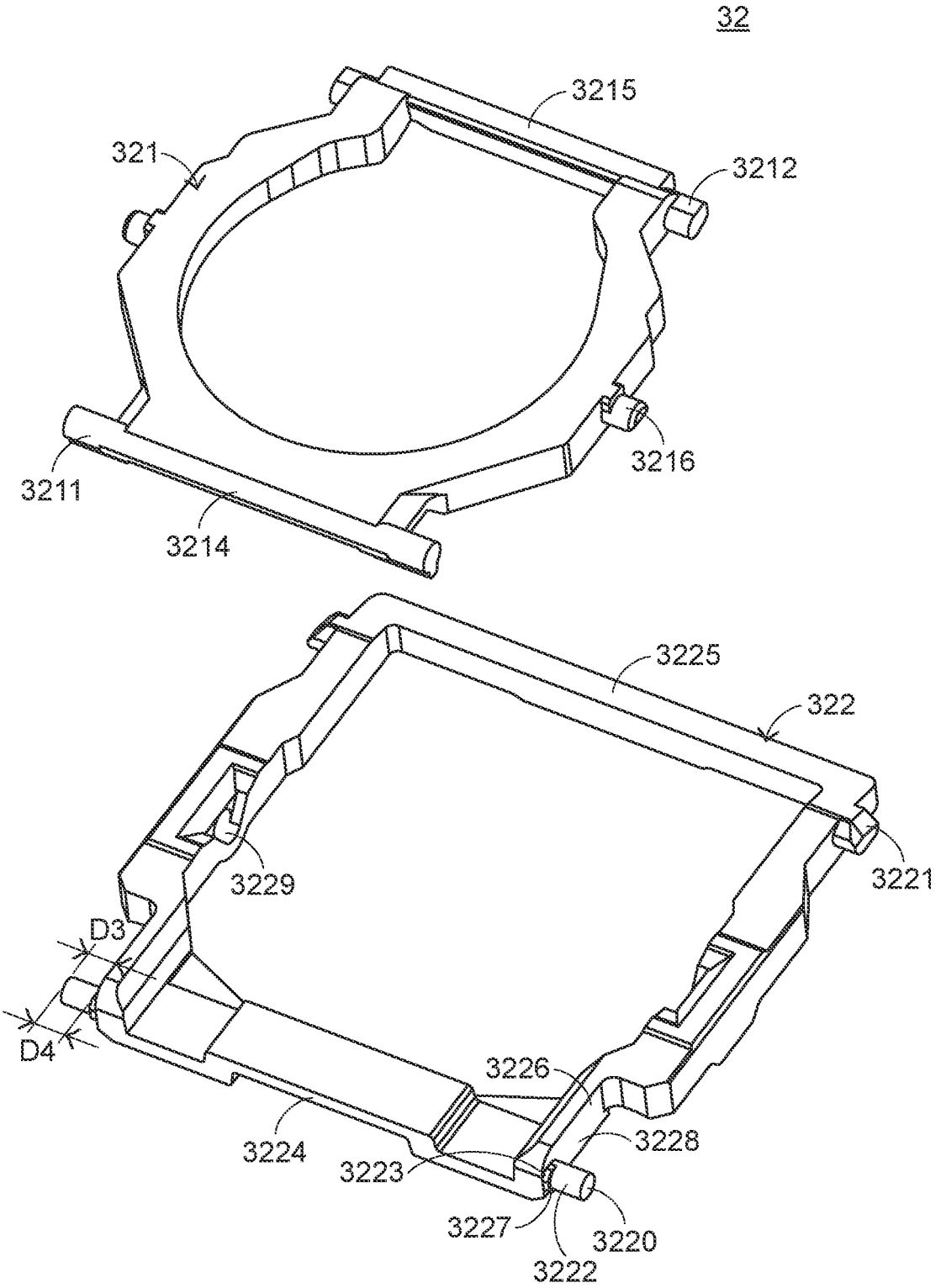
FIG. 8 is a schematic exploded view illustrating the scissors-type connecting element of the key structure according to the second embodiment of the present invention.

Hereinafter, the structure of the scissors-type connecting element 32 will be illustrated with reference to FIG. 8. FIG. 8 is a schematic exploded view illustrating the scissors-type connecting element of the key structure according to the second embodiment of the present invention. As shown in FIG. 8, the scissors-type connecting element 32 comprises a first frame 321 and a second frame 332. A first end 3214 of the first frame 321 is connected with the keycap 31. A second end 3215 of the first frame 321 is connected with the base 35. Moreover, the first frame 321 comprises a first keycap post 3211 and a first base post 3212. The first keycap post 3211 is located at the first end 3214 of the first frame 321, and connected with the keycap 31. The first base post 3212 is located at the second end 3215 of the first frame 321, and connected with the base 35.

The second frame 322 is combined with the first frame 321. A first end 3224 of the second frame 322 is connected with the base 35. A second end 3225 of the second frame 322 is connected with the keycap 31. The second frame 322 comprises a second keycap post 3221, a second base post 3222 and a bulge 3223. The second keycap post 3221 is located at the second end 3225 of the second frame 322, and connected with the keycap 31. The second base post 3222 is located at the first end 3224 of the second frame 322, and connected with the base 35. The bulge 3223 is externally extended from the first end 3224 of the second frame 322 along a longitudinal direction of the second base post 3222, and formed on a first side of the second base post 3222. Moreover, the bulge 3223 is protruded from a sidewall 3226 of the second frame 322. Consequently, a lateral surface 3227 of the bulge 3223 and a second lateral surface 3228 of the sidewall 3226 of the second frame 322 are not coplanar.

As shown in FIG. 8, the first frame 321 further comprises a rotating shaft 3216, and the second frame 322 further comprises a coupling recess 3229 corresponding to the rotating shaft 3216. The rotating shaft 3216 is located at the sidewall of the first frame 321. In addition, the rotating shaft 3216 is in parallel with the first keycap post 3211 and the first base post 3212. The rotating shaft 3216 is inserted into the corresponding coupling recess 3229, so that the first frame 321 and the second frame 322 are combined together. When the rotating shaft 3216 is rotated within the coupling recess 3229, the first frame 321 is swung relative to the second frame 322 and the scissors-type connecting element 32 is activated.

In this embodiment, the first keycap post 3211 and the first base post 3212 are integrally formed with the first frame 321, and the second keycap post 3221, the second base post 3222 and the bulge 3223 are integrally formed with the second frame 322.

After associated components are combined with each other, the key structure 3 as shown in FIG. 7 is assembled. The operations of the conventional key structure 3 in response to the depressing action of the user will be illustrated as follows. When the keycap 31 is depressed, the keycap 31 is moved downwardly to push the scissors-type connecting element 32 in response to the depressing force. Consequently, the scissors-type connecting element 32 is activated. As the keycap 31 is moved downwardly relative to the base 35, the keycap 31 pushes the corresponding triggering element 33. Since the triggering element 33 is pushed by the keycap 31, the triggering element 33 is switched from a non-triggered state to a triggered state. Consequently, the triggering element 33 generates a corresponding key signal to the circuit board 34. When the keycap 31 is no longer depressed by the user, no external force is applied to the keycap 31 and the triggering element 33 is no longer pushed by the keycap 31. In response to the elasticity of the triggering element 33, the triggering element 33 is restored to the non-triggered state. In response to the elasticity of the triggering element 33, the keycap 31 is returned to its original position where it is not depressed.

The following two aspects should be specially described. Firstly, as shown in FIG. 8, the bulge 3223 is protruded from the sidewall 3226 of the second frame 322. Consequently, a third distance D3 between a lateral surface 3220 of the second base post 3222 and the second lateral surface 3228 of the sidewall 3226 of the second frame 322 is larger than a fourth distance D4 between the lateral surface 3220 of the second base post 3222 and the lateral surface 3227 of the bulge 3223. In addition, the lateral surface 3227 of the bulge 3223 and the second lateral surface 3228 of the sidewall 3226 are in parallel with each other. Since the bulge 3223 at the first side of the second base post 3222 increases a portion of the thickness of the second base post 3222, the structural strength of the second base post 3222 is increased.

Figure 9:
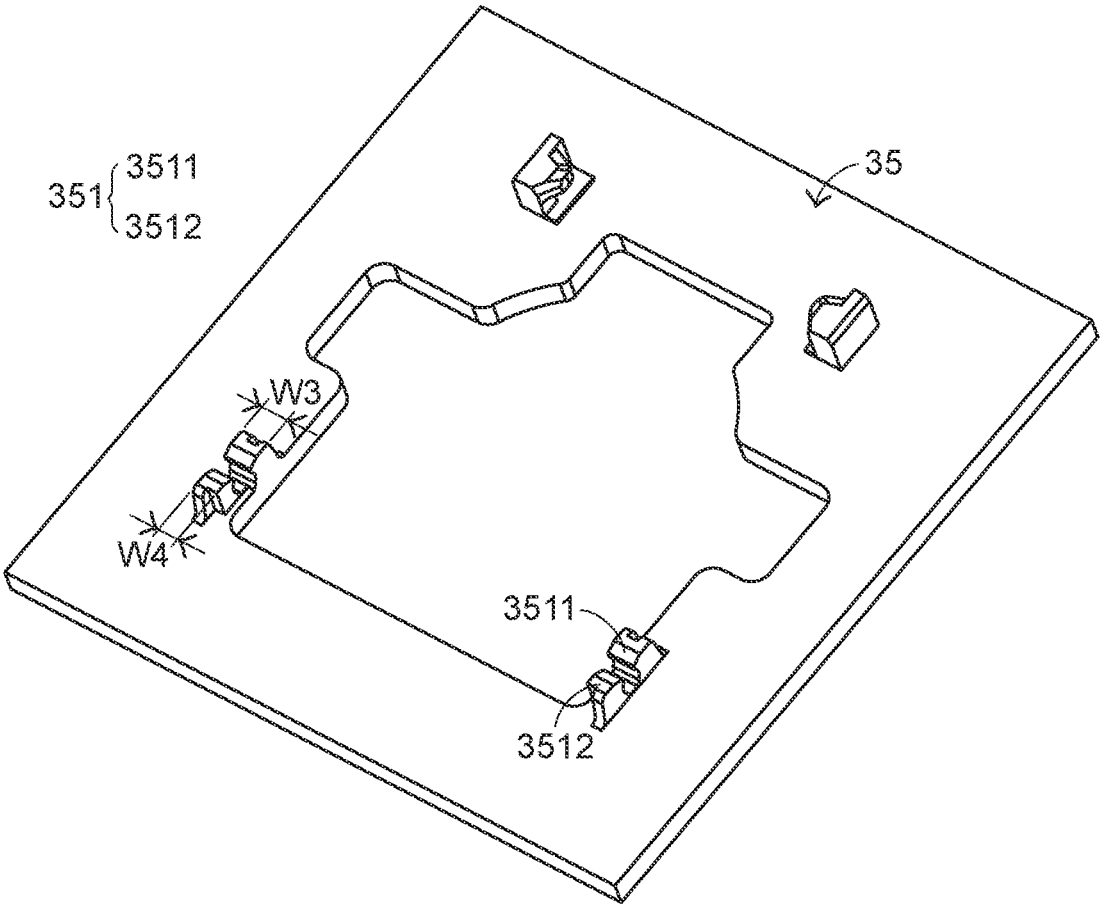
FIG. 9 is a schematic view illustrating a top side of the base of the key structure according to the second embodiment of the present invention.

Secondly, the base 35 further comprises a mating structure corresponding to the bulge 3223. FIG. 9 is a schematic view illustrating a top side of the base of the key structure according to the second embodiment of the present invention. As shown in FIG. 9, the base 35 comprises a hook structure 351. The hook structure 351 is disposed on a top surface of the keycap 31, and connected with the second base post 3222. The hook structure 351 comprises a first fixing part 3511 and a second fixing part 3512. The first fixing part 3511 is protruded from the top surface of the base 35, and contacted with a second side of the second base post 3222. The second side of the second base post 3222 is opposed to the first side of the second base post 3222, where the bulge 3223 is located at the first side of the second base post 3222. The second fixing part 3512 is protruded from the top surface of the base 35, and located beside the first fixing part 3511. The second fixing part 3512 is contacted with the first side of the second base post 3222. That is, the second fixing part 3512 is located near the bulge 3223, but is not contacted with the bulge 3223. Due to the arrangement of the bulge 3223, a third width W3 of the first fixing part 3511 is larger than a fourth width W4 of the second fixing part 3512. Since the first fixing part 3511 and the second fixing part 3512 of the hook structure 351 have different widths, the scissors-type connecting element 32 can be smoothly combined with the base 35. Moreover, the first frame 321 can be swung relative to the second frame 322 more smoothly, and the swinging action is not adversely affected by the bulge 3223.

Figure 10:
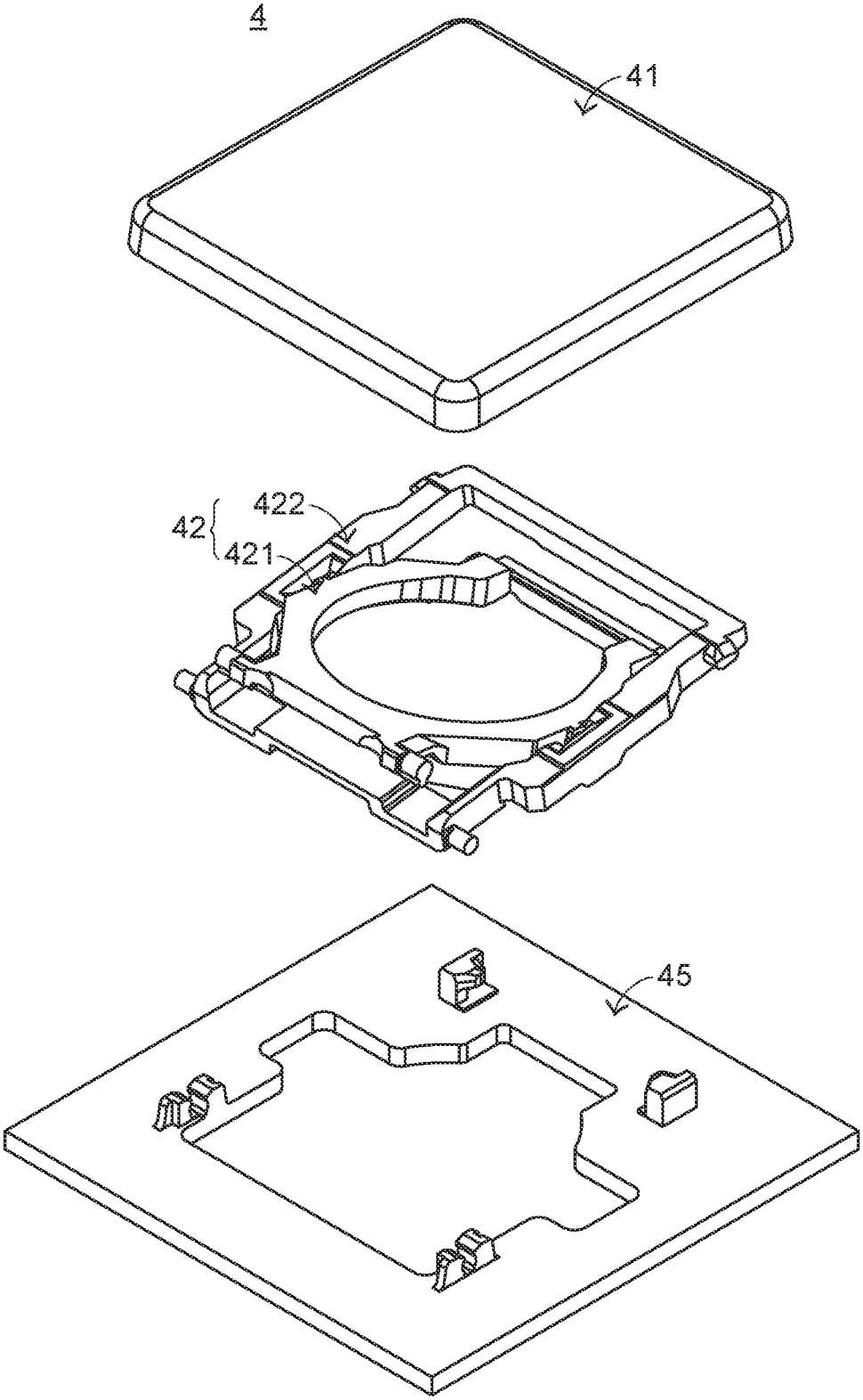
FIG. 10 is a schematic exploded view illustrating a key structure according to a third embodiment of the present invention.
Figure 11:
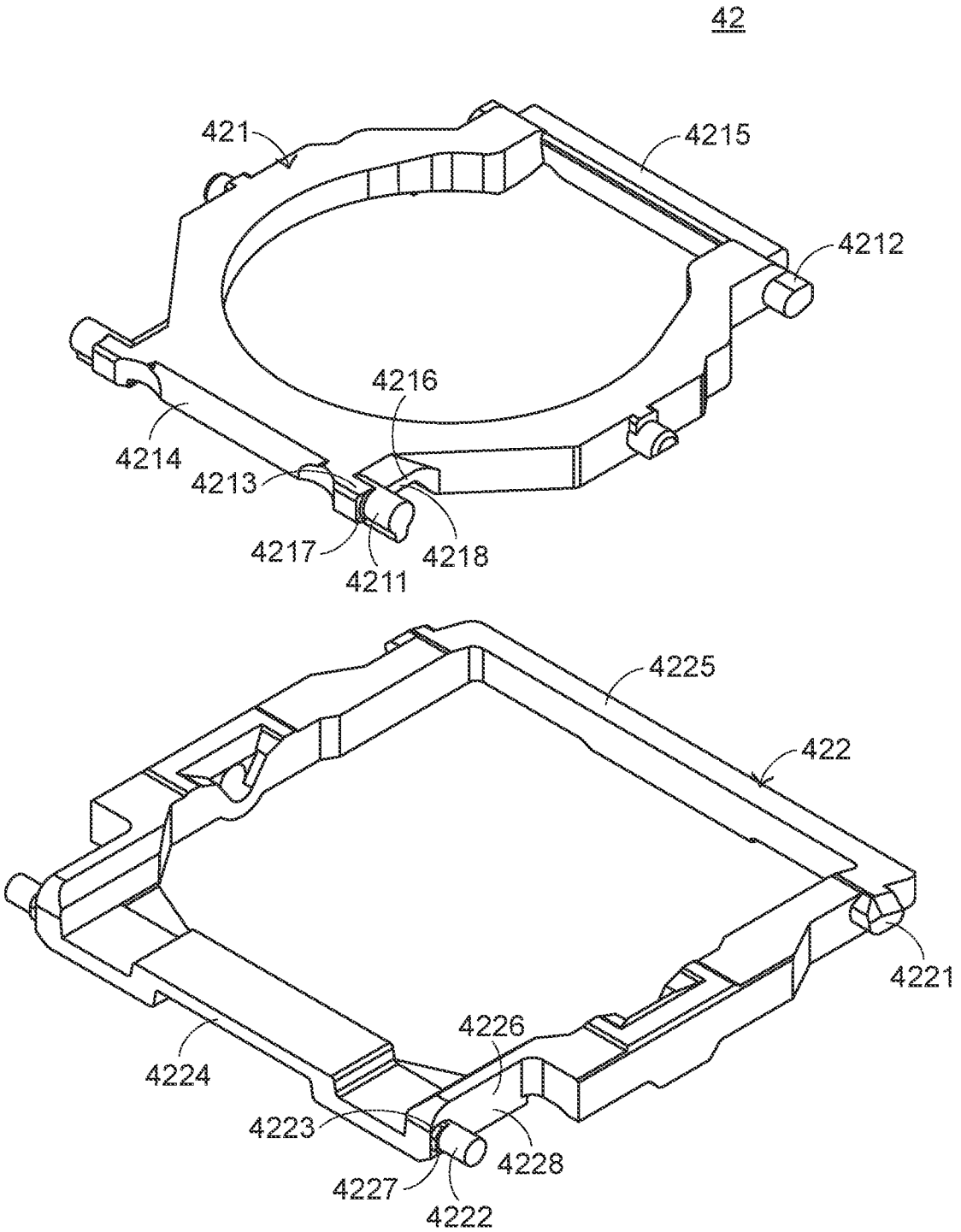
FIG. 11 is a schematic exploded view illustrating the scissors-type connecting element of the key structure according to the third embodiment of the present invention.

The present invention further provides a third embodiment, which is distinguished from the above embodiments. FIG. 10 is a schematic exploded view illustrating a key structure according to a third embodiment of the present invention. FIG. 11 is a schematic exploded view illustrating the scissors-type connecting element of the key structure according to the third embodiment of the present invention. As shown in FIGS. 10 and 11, the key structure 4 comprises a keycap 41, a scissors-type connecting element 42, a triggering element (not shown), a circuit board (not shown) and a base 45. The structures and functions of the components of the key structure 4 which are identical to those of the above two embodiments are not redundantly described herein. In comparison with the above two embodiments, the scissors-type connecting element 42 of the key structure 4 of this embodiment is distinguished.

As shown in FIG. 11, the scissors-type connecting element 42 comprises a first frame 421 and a second frame 422. A first end 4214 of the first frame 421 is connected with the keycap 41. A second end 4215 of the first frame 421 is connected with the base 45. Moreover, the first frame 421 comprises a first keycap post 4211, a first base post 4212 and a first bulge 4213. The first keycap post 4211 is located at the first end 4214 of the first frame 421, and protruded from a sidewall 4216 of the first frame 421. The first keycap post 4211 is connected with the keycap 41. The first base post 4212 is located at the second end 4215 of the first frame 421, and connected with the base 45. The first bulge 4213 is externally extended from the first end 4214 of the first frame 421 along a longitudinal direction of the first keycap post 4211, and formed on a first side of the first keycap post 4211. Moreover, the first bulge 4213 is protruded from the sidewall 4216 of the first frame 421. Consequently, a lateral surface 4217 of the first bulge 4213 and a first lateral surface 4218 of the sidewall 4216 of the first frame 421 are not coplanar.

The second frame 422 is combined with the first frame 421. A first end 4224 of the second frame 422 is connected with the base 45. A second end 4225 of the second frame 422 is connected with the keycap 41. The second frame 422 comprises a second keycap post 4221, a second base post 4222 and a second bulge 4223. The second keycap post 4221 is located at the second end 4225 of the second frame 422, and connected with the keycap 41. The second base post 4222 is located at the first end 4224 of the second frame 422, and connected with the base 45. The second bulge 4223 is externally extended from the first end 4224 of the second frame 422 along a longitudinal direction of the second base post 4222, and formed on a first side of the second base post 4222. Moreover, the second bulge 4223 is protruded from a sidewall 4226 of the second frame 422. Consequently, a lateral surface 4227 of the second bulge 4223 and a second lateral surface 4228 of the sidewall 4226 of the second frame 422 are not coplanar.

In this embodiment, the first frame 421 has the first bulge 4213 for increasing the structural strength of the first keycap post 4211, and the second frame 422 has the second bulge 4223 for increasing the structural strength of the second base post 4222. Moreover, the keycap 41 further comprises a mating structure (not shown) corresponding to the first bulge 4213. The mating structure of the keycap 41 is similar to the mating structure of the keycap 21 of FIG. 5, and is not redundantly described herein. Moreover, the base 45 further comprises a mating structure (not shown) corresponding to the second bulge 4223. The mating structure of the base 45 is similar to the mating structure of the base 35 of FIG. 9, and is not redundantly described herein. In other words, the structural strengths of the first keycap post 4211 and the second base post 4222 of the key structure 4 are both increased.

From the above descriptions, the present invention provides the key structure. In the scissors-type connecting element of the key structure, a bulge is formed on a sidewall of the keycap post or a sidewall of the base post in order to increase the volume of the keycap or the base post. Consequently, the structural strength is increased, and the damage probability is reduced. Moreover, due to the arrangement of the bulge, the keycap or the base has a mating structure corresponding to the bulge. Consequently, the scissors-type connecting element can be smoothly combined with the keycap or the base, and the action of the scissors-type connecting element is not adversely affected by the bulge.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A key structure, comprising:

a base;

a triggering element, wherein the triggering element is triggered in response to an external force;

a keycap disposed over the triggering element, wherein the keycap comprises a hook structure disposed on a bottom surface of the keycap and when the external force is applied to the keycap, the triggering element is pushed by the keycap; and a scissors-type connecting element connected with the keycap and the base, and comprising:

a first frame having a first end connected with the keycap and a second end connected with the base, wherein the first frame comprises a first keycap post, a first base post and a bulge, wherein the first keycap post is located at the first end of the first frame, protruded from a sidewall of the first frame, and connected with the hook structure of the keycap, wherein the first base post is located at the second end of the first frame, and connected with the base, wherein the bulge is externally extended from the first end of the first frame and formed on a first side of the first keycap post, and the bulge is protruded from the sidewall of the first frame; and a second frame combined with the first frame, wherein a first end of the second frame is connected with the base, and a second end of the second frame is connected with the keycap.

2. The key structure according to claim 1, wherein a first distance between a lateral surface of the first keycap post and the sidewall of the first frame is larger than a second distance between the lateral surface of the first keycap post and a lateral surface of the bulge, wherein the lateral surface of the bulge and a lateral surface of the sidewall of the first frame are in parallel with each other.

3. The key structure according to claim 1, wherein the hook structure of the key cap comprises:

a first fixing part protruded from the bottom surface of the keycap, and contacted with a second side of the first keycap post; and a second fixing part protruded from the bottom surface of the keycap, located beside the first fixing part, and contacted with the first side of the first keycap post, wherein a first width of the first fixing part is larger than a second width of the second fixing part.

4. The key structure according to claim 1, further comprising a circuit board, wherein the circuit board is disposed under the base and electrically connected with the triggering element, and the triggering element is supported by the circuit board, wherein when the triggering element is pushed by the keycap, the triggering element generates a key signal to the circuit board, wherein the triggering element is a triggering switch.

5. The key structure according to claim 1, further comprising a switch circuit board, wherein the switch circuit board is disposed under the triggering element, wherein when the triggering element is subjected to deformation, the switch circuit board is triggered to generate a key signal, wherein the triggering element is a rubbery elastomer.

6. The key structure according to claim 1, wherein the second frame comprises:

a second keycap post located at the second end of the second frame, and connected with the keycap; and a second base post located at the first end of the second frame, and connected with the base.

7. The key structure according to claim 6, wherein the first keycap post, the first base post and the bulge are integrally formed with the first frame, and the second keycap post and the second base post are integrally formed with the second frame.

8. The key structure according to claim 6, wherein the second frame further comprises an additional bulge, wherein the additional bulge is externally extended from the first end of the second frame and formed on a first side of the second base post, and the additional bulge is protruded from a sidewall of the second frame.

9. A key structure, comprising:

a base, wherein the base comprises a hook structure disposed on a top surface of the base;

a triggering element, wherein the triggering element is triggered in response to an external force;

a keycap disposed over the triggering element, wherein when the external force is applied to the keycap, the triggering element is pushed by the keycap; and a scissors-type connecting element connected with the keycap and the base, and comprising:

a first frame, wherein a first end of the first frame is connected with the keycap, and a second end of the first frame is connected with the base; and a second frame combined with the first frame, wherein a first end of the second frame is connected with the base, and a second end of the second frame is connected with the keycap, wherein the second frame comprises a first base post, a first keycap post and a bulge, wherein the first base post is located at the first end of the second frame, protruded from a sidewall of the second frame, and connected with the hook structure of the base, wherein the first keycap post is located at the second end of the second frame, and connected with the keycap, wherein the bulge is externally extended from the first end of the second frame and formed on a first side of the first base post, and the bulge is protruded from the sidewall of the second frame.

10. The key structure according to claim 9, wherein a first distance between a lateral surface of the first base post and the sidewall of the second frame is larger than a second distance between the lateral surface of the first base post and a lateral surface of the bulge, wherein the lateral surface of the bulge and a lateral surface of the sidewall of the second frame are in parallel with each other.

11. The key structure according to claim 9, wherein the hook structure of the base comprises:

a first fixing part protruded from the top surface of the base, and contacted with a second side of the first base post; and a second fixing part protruded from the top surface of the base, located beside the first fixing part, and contacted with the first side of the first base post, wherein a first width of the first fixing part is larger than a second width of the second fixing part.

12. The key structure according to claim 9, further comprising a circuit board, wherein the circuit board is disposed under the base and electrically connected with the triggering element, and the triggering element is supported by the circuit board, wherein when the triggering element is pushed by the keycap, the triggering element generates a key signal to the circuit board, wherein the triggering element is a triggering switch.

13. The key structure according to claim 9, further comprising a switch circuit board, wherein the switch circuit board is disposed under the triggering element, wherein when the triggering element is subjected to deformation, the switch circuit board is triggered to generate a key signal, wherein the triggering element is a rubbery elastomer.

14. The key structure according to claim 9, wherein the first frame comprises:

a second keycap post located at the first end of the first frame, and connected with the keycap; and a second base post located at the second end of the first frame, and connected with the base.

15. The key structure according to claim 14, wherein the first keycap post, the first base post and the bulge are integrally formed with the second frame, and the second keycap post and the second base post are integrally formed with the first frame.

16. The key structure according to claim 14, wherein the first frame further comprises an additional bulge, wherein the additional bulge is externally extended from the first end of the first frame and formed on a first side of the second keycap post, and the additional bulge is protruded from a sidewall of the first frame.

* * * * *